US005744785A

United States Patent [19]

Lee

[11] Patent Number: 5,744,785

[45] Date of Patent: Apr. 28, 1998

[54] METHOD FOR AUTOMATICALLY CONTROLLING COOKING BY USING A VAPOR SENSOR IN A MICROWAVE OVEN

[75] Inventor: Charng-Gwon Lee, Bupyeon-ku, Rep. of Korea

[73] Assignee: Daewoo Electronics Co. Ltd., Seoul, Rep. of Korea

[21] Appl. No.: 652,136

[22] Filed: May 23, 1996

[30] Foreign Application Priority Data

Sep. 29, 1995 [KR] Rep. of Korea ..... 95-33037

[51] Int. Cl.[6] ..... H05B 6/68

[52] U.S. Cl. ..... 219/707; 219/705; 219/757; 99/325

[58] Field of Search ..... 219/707, 705, 219/757; 99/325

[56] References Cited

U.S. PATENT DOCUMENTS

| | | | |
|---|---|---|---|
| 4,383,158 | 5/1983 | Niwa | 219/707 |
| 4,791,263 | 12/1988 | Groeschel, Jr. | 219/707 |
| 5,319,171 | 6/1994 | Tazawa | 219/705 |
| 5,395,633 | 3/1995 | Lee | 426/233 |
| 5,436,433 | 7/1995 | Kim | 219/703 |
| 5,445,009 | 8/1995 | Yang | 73/29.01 |
| 5,464,967 | 11/1995 | Gong | 219/707 |
| 5,552,584 | 9/1996 | Idebro | 219/707 |

*Primary Examiner*—Philip H. Leung

[57] ABSTRACT

A method for automatically controlling cooking by using a vapor sensor in a microwave oven is disclosed. The method for automatically controlling cooking air-cools the cavity for a predetermined time by means of the driving of a fan motor during the automatic cooking operation, and respectively compares magnitude and phase of a signal-processed detecting signal supplied from a detecting signal processing circuit section with magnitude of reference detecting signal and values of reference phases in order to discriminate the polarity of the signal-processed detecting signal. Also, the executing time of the air-cooling operation related to a cooking chamber, which is additionally provided in response to the discriminated polarity, is discriminately adjusted. Therefore, an overcooked or an under-cooked result, caused by an additional air cooling time having a fixed value, is prevented so that the user's expectation of reliability concerning the performance and the life span of the microwave oven are significantly enhanced and satisfied.

13 Claims, 6 Drawing Sheets

METHOD FOR AUTOMATICALLY CONTROLLING COOKING BY USING A VAPOR SENSOR IN A MICROWAVE OVEN

BACKGROUND OF THE INVENTION

1. Field of the Invention

The present invention relates to a method for automatically controlling cooking by using a vapor sensor in a microwave oven. More particularly, the present invention relates to the method for automatically controlling cooking by using a vapor sensor in a microwave oven in which the output of the vapor sensor, which varies in accordance with the condition of a cooking chamber, is detected in order to discriminately provide air cooling time while an automatic cooking operation is being performed by the microwave oven equipped with the vapor sensor therein.

2. Description of the Prior Art

FIG. 1 is a schematic construction view showing an internal structure of a general microwave oven equipped with a vapor sensor therein. As shown in FIG. 1, in a microwave oven 10 for controlling an automatic cooking operation by using the vapor sensor, while a high voltage transformer 100 applies high voltage electricity to a magnetron 200, microwaves are generated from magnetron 200, and the microwaves heat food within a cooking chamber formed by a cavity 300.

Meanwhile, water vapor generated from the heated food is then discharged along the air flow which effuses from first blow holes 311 formed in the upper portion of a first sidewall 310 of cavity 300 by a blowing operation of a fan motor 400 and passes sequentially through first exhaust holes 321 formed in the lower portion of a second sidewall 320 oppositely disposed to first sidewall 310 and first discharge holes 500. Also, the water vapor is discharged along the air flow which sequentially passes through second exhaust holes 331 formed in the central portion of a ceiling portion 330 of cavity 300, through a wind path 600, and through second discharge holes 700. Then, the water vapor discharged along wind path 500 is sensed by a vapor sensor 800 which also has the characteristic of a piezo-electric device attached to inlets of second discharge holes 700, so that the heating time is adequately controlled during the automatic cooking operation.

FIG. 2 is a construction view for showing the internal structure of the vapor sensor. As shown in FIG. 2, vapor sensor 800, called superconducting sensor, has the shape of a disc, and has a structure in which a first disc 820 made of ceramic is located in the central portion of the disc and a second disc 830 surrounds first disc 820. A first electrode terminal 821 and a second electrode terminal 831 are respectively fixed to connect with first disc 820 and second disc 830. When vapor sensor 800 sucks in or discharges heat, vapor sensor 800 generates a detecting signal 810 through first electrode terminal 821 and second electrode terminal 831.

One example of an automatic thawing device of a microwave oven and a control method thereof is disclosed in U.S. Pat. No. 5,436,433 (issued to Kim et al.). Here, a turntable is rotatably placed in a cooking chamber. A gas sensor is placed about an exhaust port of the microwave oven, and senses the amount of gas or vapor exhausted from the cooking chamber through the exhaust port during a thawing operation, and outputs a gas amount signal to a microprocessor. The microprocessor calculates the thawing time by an operation activated by an output signal of the gas sensor and outputs a thawing control signal for driving the microwave oven. An output drive means controls the output level of electromagnetic waves of high frequency in accordance with the thawing control signal of the microprocessor. The magnetron generates the electromagnetic wave of high frequency in accordance with the output signal of the drive means for the thawing time. A power source supplies electric power to the thawing device in accordance with the thawing control signal of the microprocessor.

U.S. Pat. No. 5,445,009 (issued to Yang et al.) is an example of an apparatus and a method for detecting humidity in a microwave oven. The apparatus and method for removing the influence of microwave noise without any shielding parts increases the reliability of detected humidity information. According to this patent, the cumulative difference of humidity values sensed by a humidity sensor is calculated for each half period of a commercial alternating current frequency, oscillating and non-oscillating terms of a magnetron are determined by comparing the calculated cumulative differences with each other, and the humidity-sensed values obtained during the determined non-oscillating terms of the magnetron are used as humidity information for automatic cooking control. In order to even further remove the influence of microwave noise, the humidity sensor may include capacitors for bypassing the microwave noise introduced into the sensor.

As one example of a method for automatically controlling the cooking of food with a low moisture content, U.S. Pat. No. 5,395,633 (issued to Lee et al.) discloses an automatic cooking control method capable of cooking food with an optimum low moisture content by utilizing a variation in an output voltage of a humidity sensor. When a key signal corresponding to the food with low moisture content is received, initialization is performed. Then, the maximum voltage indicative of the maximum humidity is determined by reading the continuously increasing output voltage from the humidity sensor 10 times in 10 seconds. After determining the maximum voltage, a determination is made as to whether the output voltage has reached the sensing voltage corresponding to the voltage obtained by deducing from the maximum voltage a minute voltage which varies depending on the kind of food in the oven. The cooking operation is completed when the output voltage from the humidity sensor has reached the sensing voltage.

As described above, in the case of a conventional microwave oven which controls the automatic cooking operation by using the vapor sensor, in general, detecting signal 810 generated from vapor sensor 800 oscillates up and down on the basis of a reference detecting signal which corresponds to an objective value. Hereinafter, "positive polarity mode" will be defined as the case where the magnitude of detecting signal 810 is greater than the magnitude of the reference detecting signal. To the contrary, "negative polarity mode" will be defined as the case where the magnitude of detecting signal 810 is smaller than the magnitude of the reference detecting signal. Therefore, the sign of the curve slope of detecting signal 810 has a positive or negative polarity in a specified range on the phase coordinate axis. Here, "phase" means a discrete value of time which is counted by a counter, and "slope" means a differential value at a certain point indicated by a corresponding phase coordinate value and a magnitude coordinate value. The vapor sensor 800 sucks in or discharges the heat contained in the water vapor which is generated from the food subjected to heat and placed in a cavity 300, and which flows outward through a wind path 600. Then, if the factors of detecting signal 810 supplied from vapor sensor 800 are respectively referred to as a first detecting signal and a second detecting signal, the first detecting signal has a positive slope and the second detecting signal has a negative slope, so that these two detecting signals are apparently distinguished from each other.

Also, while a continuous heating operation is executed in the automatic cooking operation, a relevant air cooling time is selected from a time value which is determined by experiment as being sufficient. However, when the continuous heating operation is executed for the same amount of food subjected to heating in the state where the air cooling time is fixed to a constant value, the air cooling time cannot be adequately varied in accordance with the condition of the cooking chamber. Namely, since the current air cooling time is fixed to a constant value, the cooking result therefrom is different from the one obtained by experiment. At this time, a user misunderstands the performance of the microwave oven since the user expects the same cooking result with respect to the same food subjected to heating regardless of the heating condition within the cooking chamber.

Therefore, both the user's expectation of reliability concerning the performance of the microwave oven and the consumer's intention with which the microwave oven is purchased, are left unsatisfied.

SUMMARY OF THE INVENTION

Accordingly, it is a first object of the present invention to provide a method for automatically discriminating whether a detecting signal supplied from a vapor sensor (i.e., a signal-processed detecting signal supplied from a detecting signal processing circuit section) and varied in accordance with the condition of a cooking chamber (i.e., a cavity), has a positive polarity mode or a negative polarity mode while an automatic cooking operation is being performed by means of a microwave oven equipped with a vapor sensor therein.

It is a second object of the present invention to provide a method for discriminately adjusting the air cooling time related to a cooking chamber in response to the discriminated polarity of the signal-processed detecting signal while the automatic cooking operation is being performed.

In order to achieve the above first and second objects of the present invention, the present invention provides a method for automatically controlling cooking by using a vapor sensor in a microwave oven, which comprises the steps of:

(i) operating a blowing means for a first operating time by a control means so as to remove water vapor which remains in a cavity, thereby air-cooling the cavity while food is being cooked using a microwave oven equipped with a vapor sensor therein;

(ii) initializing to zero both a value of a first counter and a value of a second counter in order to measure a magnitude of a signal-processed detecting signal supplied from a detecting signal processing circuit section which inputs and signal-processes a detecting signal supplied from the vapor sensor;

(iii) recording the measured magnitude of the signal-processed detecting signal supplied from the detecting signal processing circuit section in response to the wind, which is produced by the operation of the blowing means and which passes sequentially through second exhaust holes formed in the central portion of a ceiling portion of the cavity, through a wind path and through second discharge holes;

(iv) comparing the value of the first counter or the value of the second counter with values of reference phases in accordance with the measured magnitude of the signal-processed detecting signal;

(v) calculating an air cooling time corresponding to an additional air cooling time in accordance with the value of the first counter or the value of the second counter;

(vi) operating, by means of the control means, the blowing means for the second air cooling time calculated in step (v) in order to additionally air-cool the cavity; and (vii) heating in succession food placed in the cavity.

Preferably, the step (i) comprises the substeps of:

(a) initializing to zero the first operating time of the blowing means;

(b) increasing by one the first operating time of the blowing means;

(c) judging whether or not the first operating time of the blowing means, which was increased by one in step (b), is greater than or equal to a first air cooling time;

(d) returning to step (b) and repeating the succeeding steps when it is judged in step (c) that the first operating time of the blowing means is smaller than the first air cooling time; and (e) performing step (ii) when it is judged in step (c) that the first operating time of the blowing means is greater than or equal to the first air cooling time.

Furthermore, preferably, the step (iii) comprises the substeps of:

(f) measuring, by a first measuring means, the magnitude of the signal-processed detecting signal supplied from the detecting signal processing circuit section; and (g) recording on a first memory means the magnitude, measured in step (f), of the signal-processed detecting signal.

Furthermore, preferably, the step (iv) comprises the substeps of:

(k) judging whether or not the magnitude, measured in step (iii), of the signal-processed detecting signal is equal to or smaller than a magnitude of a reference detecting signal;

(l) judging whether or not the value of the second counter is zero when it is judged in step (k) that the magnitude of the signal-processed detecting signal is greater than the magnitude of the reference detecting signal;

(m) initializing to zero the value of the first counter, increasing by one the value of the second counter, and returning to step (iii) in order to repeat the succeeding steps when it is judged in step (l) that the value of the second counter is not zero;

(n) judging whether or not the value of the first counter is smaller than a value of a third reference phase when it is judged in step (l) that the value of the second counter is zero;

(o) initializing to zero the value of the first counter, increasing by one the value of the second counter, and returning to step (iii) in order to repeat the succeeding steps when it is judged in step (n) that the value of the first counter is smaller than the value of the third reference phase;

(p) performing step (v) when it is judged in step (n) that the value of the first counter is greater than or equal to the value of the third reference phase;

(q) judging whether or not the value of the first counter is zero when it is judged in step (k) that the magnitude of the signal-processed detecting signal is equal to or smaller than the magnitude of the reference detecting signal;

(r) increasing by one the value of the first counter, initializing to zero the value of the second counter, and returning to step (iii) in order to repeat the succeeding steps when it is judged in step (q) that the value of the first counter is not zero;

(s) judging whether or not the value of the second counter is smaller than a value of a fifth reference phase when it is judged in step (q) that the value of the first counter is zero;

(t) increasing by one the value of the first counter, initializing to zero the value of the second counter, and returning to step (iii) in order to repeat the succeeding steps when it is judged in step (s) that the value of the second counter is smaller than the value of the fifth reference phase; and (u) performing step (v) when it is judged in step (s) that the value of the second counter is greater than or equal to the value of the fifth reference phase.

Furthermore, preferably, the step (v) comprises the sub-steps of:

(A) judging whether or not the value of the first counter having the value set in step (iv) is smaller than a value of a fourth reference phase;

(B) setting the second air cooling time of the blowing means to a first additionally-operating time when it is judged in step (A) that the value of the first counter is smaller than the value of the fourth reference phase;

(C) setting the second air cooling time of the blowing means to a second additionally-operating time when it is judged in step (A) that the value of the first counter is greater than or equal to the value of the fourth reference phase;

(D) judging whether or not the value of the second counter having the value set in step (iv) is smaller than a value of a sixth reference phase;

(E) setting the second air cooling time of the blowing means to a third additionally-operating time when it is judged in step (D) that the value of the second counter is smaller than the value of the sixth reference phase; and (F) setting the second air cooling time of the blowing means to a fourth additionally-operating time when it is judged in step (D) that the value of the second counter is greater than or equal to the value of the sixth reference phase.

Furthermore, preferably, the first additionally-operating time is the right side of an equation of "$T_2=0$", where the second air cooling time is denoted by $T_2$. Also, the second additionally-operating time is the right side of an equation of "$T_2=C_1\times T_a+T_b$", where the second air cooling time and the value of the first counter are respectively denoted by $T_2$ and $C_1$, and both $T_a$ and $T_b$ are coefficients determined on the basis of data obtained by experiment. The third additionally-operating time is the right side of an equation of "$T_2=T_c$", where the second air cooling time is denoted by $T_2$, and $T_c$ is a coefficient determined on the basis of data obtained by experiment. The fourth additionally-operating time is the right side of an equation of "$T_2=C_2\times T_d+T_e$", where the second air cooling time and the value of the second counter are respectively denoted by $T_2$ and $C_2$, and both $T_d$ and $T_e$ are coefficients determined on the basis of data obtained by experiment.

Furthermore, preferably, the value of the first counter has a range specified by an inequality of "$C_{r3}\leqq C_1<C_{r4}$" when the second air cooling time is set to the first additionally-operating time, where the value of the first counter, and the values of the third and fourth reference phases are respectively denoted by $C_1$, $C_{r3}$ and $C_{r4}$. Also, the value of the first counter has a range specified by an inequality of "$C_{r4}\leqq C_1$" when the second air cooling time is set to the second additionally-operating time, where the value of the first counter and the value of the fourth reference phase are respectively denoted by $C_1$ and $C_{r4}$. The value of the second counter has a range specified by an inequality of "$C_{r5}\leqq C_2<C_{r6}$" when the second air cooling time is set to the third additionally-operating time, where the value of the second counter, and the values of the fifth and sixth reference phases are respectively denoted by $C_2$, $C_{r5}$ and $C_{r6}$. The value of the second counter has a range specified by an inequality of "$C_{r6}\leqq C_2$" when the second air cooling time is set to the fourth additionally-operating time, where the value of the second counter and the value of the sixth reference phase are respectively denoted by $C_2$ and $C_{r6}$.

Furthermore, preferably, the step (vi) comprises the sub-steps of:

(K) initializing to zero the second operating time of the blowing means;

(L) increasing by one the second operating time of the blowing means;

(M) judging whether or not the second operating time, increased by one in step (L), of the blowing means is greater than or equal to the second air cooling time;

(N) returning to step (L) and repeating the succeeding steps when it is judged in step (M) that the second operating time of the blowing means is smaller than the second air cooling time; and (O) performing step (vii) when it is judged in step (M) that the second operating time of the blowing means is greater than or equal to the second air cooling time.

In the method for automatically controlling cooking by using a vapor sensor in a microwave oven according to the present invention, the executing time of the air cooling operation is discriminately adjusted in accordance with the signal-processed detecting signal, so that an overcooked or an under-cooked result caused by an additional air cooling time having a fixed value is prevented.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

A detailed description will be given below, with reference to the accompanying drawings, of a configuration and a relevant operation of a method for automatically controlling cooking by using a vapor sensor in a microwave oven according to an embodiment of the present invention.

Figure 1:
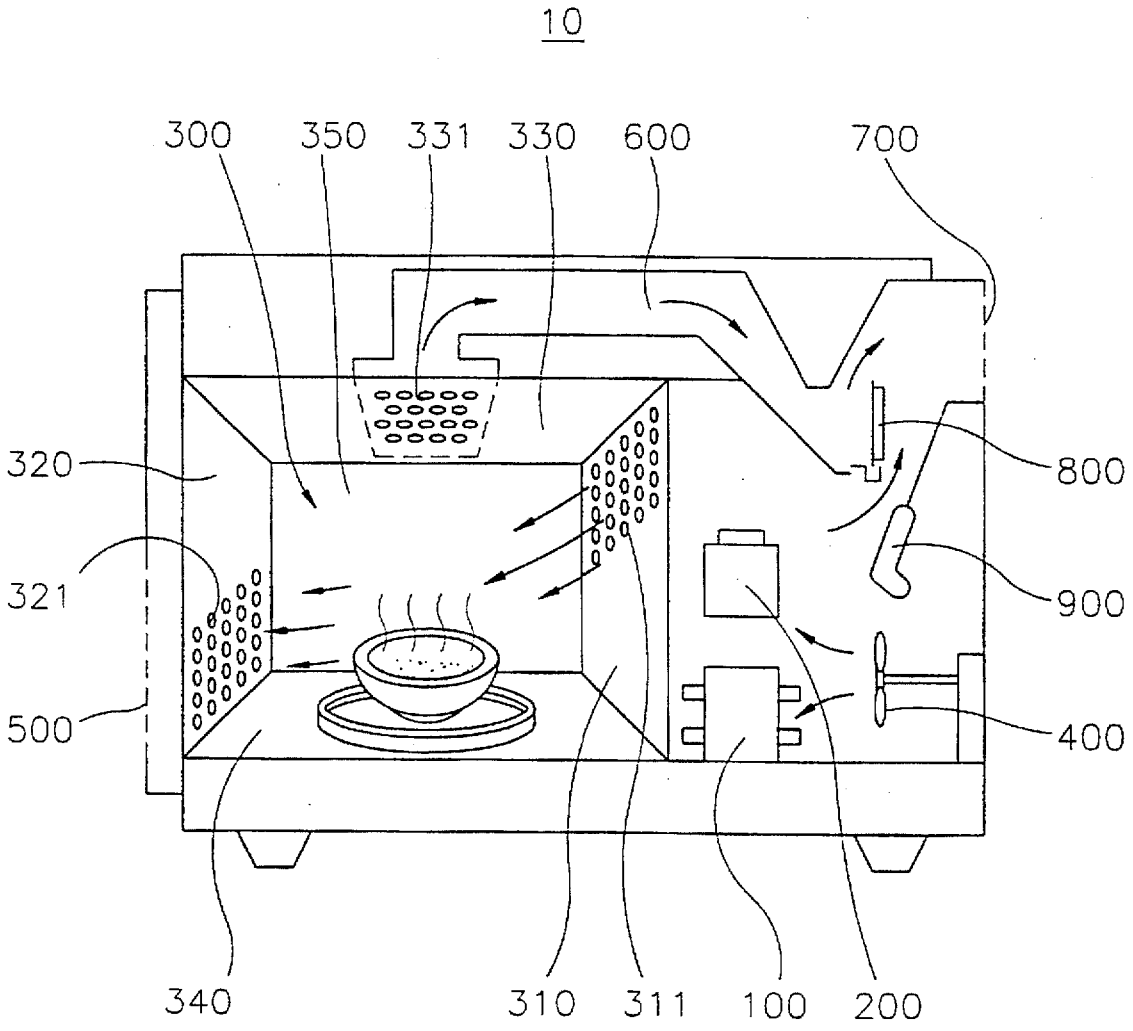
FIG. 1 PRIOR ART
FIG. 1 is a schematic construction view for showing an internal structure of a general microwave oven equipped with a vapor sensor therein.

FIG. 1 is a schematic construction view for showing an internal structure of a general microwave oven equipped with a vapor sensor therein. As shown in FIG. 1, a microwave oven 10 includes a cavity 300 which is disposed at the left half portion thereof to form a cooking chamber, and is equipped with a variety of electric devices at the right half portion therein, which perform an automatic cooking operation of microwave oven 10. Cavity 300 includes a first sidewall 310 arranged on the right side, a second sidewall 320 arranged on the left side, a ceiling portion 330 arranged in the upper portion, a floor portion 340 arranged in the lower portion thereof, and a rear surface portion 350 arranged rearward. First sidewall 310 has first blow holes 311 in the upper portion thereof. Second sidewall 320 has first exhaust holes 321 in the lower portion thereof. Ceiling portion 330 has second exhaust holes 331 in the central portion thereof. A main body of microwave oven 10 includes first discharge holes 500 in the lower portion of the left outer wall. First discharge holes 500 are interconnected with first exhaust holes 321. The main body of microwave oven 10 has a wind path 600 arranged over cavity 300, and an inlet of wind path 600 is interconnected with second exhaust holes 331 included in ceiling portion 330 of cavity 300. The main body of microwave oven 10 further has second discharge holes 700 in the upper portion of the right outer wall thereof. Second discharge holes 700 are interconnected with an outlet of wind path 600.

Vapor sensor 800 is internally installed in the right half portion of the main body included in microwave oven 10, and detects water vapor generated from food subjected to heating while the automatic cooking operation is being performed. Also, the right half portion included in the main body of microwave oven 10 is internally equipped with a high voltage transformer 100 that applies high voltage electricity to a magnetron 200 which generates microwaves, a fan motor 400 which promotes a blowing operation, and an orifice 900. A door (not shown) is installed in the front surface portion of cavity 300 and isolates cavity 300 from external space during the automatic cooking operation.

Figure 2:
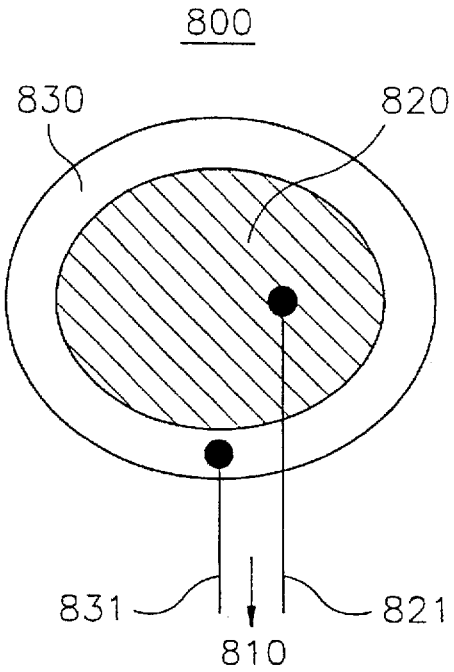
FIG. 2 is a construction view for showing an internal structure of a vapor sensor.
Figure 3:
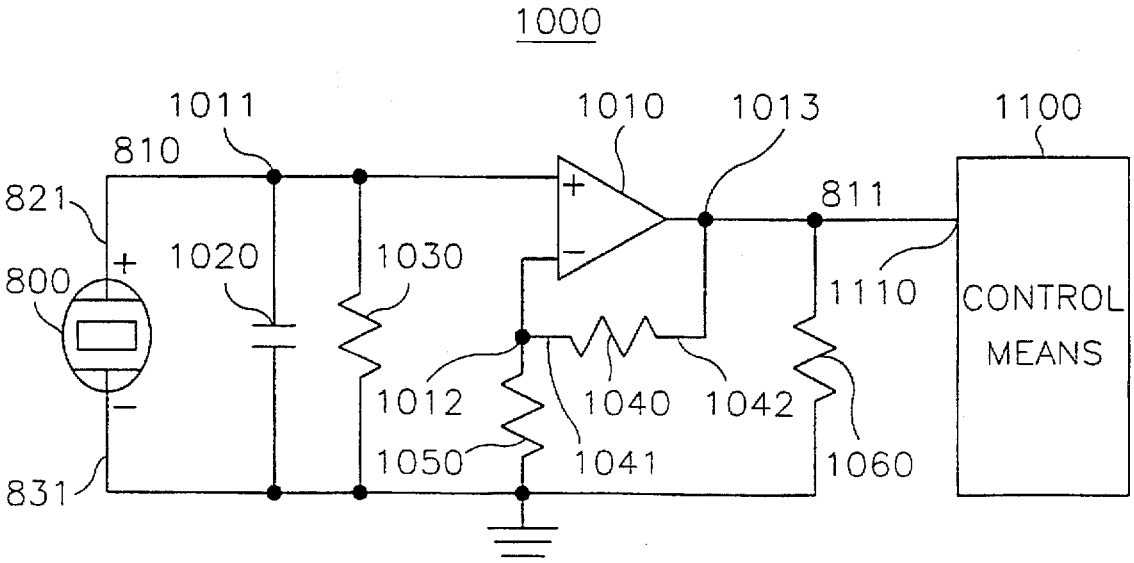
FIG. 3 is a circuit block diagram for showing a configuration of one embodiment of a detecting signal processing circuit section for processing a detecting signal supplied from the vapor sensor shown in FIG. 2.

FIG. 3 is a circuit block diagram for showing a configuration of one embodiment of a detecting signal processing circuit section for processing a detecting signal supplied from the vapor sensor shown in FIG. 2. In the detecting signal processing circuit section 1000 shown in FIG. 3, a first electrode terminal 821, corresponding to a positive electrode terminal of vapor sensor 800, is connected with a non-inverting(+) input terminal of an operational amplifier 1010 to form a first commonly-connecting point 1011, and a second electrode terminal 831 corresponding to the negative electrode terminal of vapor sensor 800, is connected with an earth connection. Condenser 1020 is connected between commonly-connecting point 1011 and the earth connection in order to refine the waveform of detecting signal 810. Also, a first resistor 1030 is connected between first connecting point 1011 and the earth connection in order to convert a current signal of detecting signal 810 supplied from vapor sensor 800 to a voltage signal. Operational amplifier 1010 amplifies detecting signal 810 generated from vapor sensor 800. A second resistor 1040 for a negative feedback is connected between the inverting(−) input terminal and the output terminal of operational amplifier 1010 in order to perform the negative feedback operation by feedbacking the portion of a current signal amplified by operational amplifier 1010. First side terminal 1041 of second resistor 1040 is connected with the inverting(−) input terminal of operational amplifier 1010 to form a second commonly-connecting point 1012. A third resistor 1050 is connected between second commonly-connecting point 1012 and the earth connection in order to apply a bias voltage to the inverting(−) input terminal of operational amplifier 1010. Second side terminal 1042 of second resistor 1040 is connected with the output terminal of operational amplifier 1010 to form a third commonly-connecting point 1013. A fourth resistor 1060 for the voltage output is connected between third commonly-connecting point 1013 and the earth connection in order to transform a current signal to a voltage signal. The output of operational amplifier 1010 is connected with a detecting signal input terminal 1110 of a control means 1100 in order to provide detecting signal 810 generated from vapor sensor 800 to control means 1100.

A measuring point of detecting signal 810 is first commonly-connecting point 1011 with which both the non-inverting(+) input terminal of operational amplifier 1010 and first electrode terminal 821 of vapor sensor 800 are directly connected. Detecting signal 810 at first commonly-connecting point 1011 has the waveform corresponding to the form of an alternating current signal. However, the signal-processed detecting signal 811 outputted at third commonly-connecting point 1013 only has a positive value by the signal processing operation of operational amplifier 1010, which is an amplifying device.

In the present invention, first electrode terminal 821 connected with first disc 820, which is made of ceramic materials is defined as a positive terminal (refer to FIG. 2). In this case, detecting signal 810 from vapor sensor 800 has the characteristics that detecting signal 810 at first commonly-connecting point 1011 increases in the positive voltage direction while vapor sensor 800 sucks in heat.

Figure 4A:
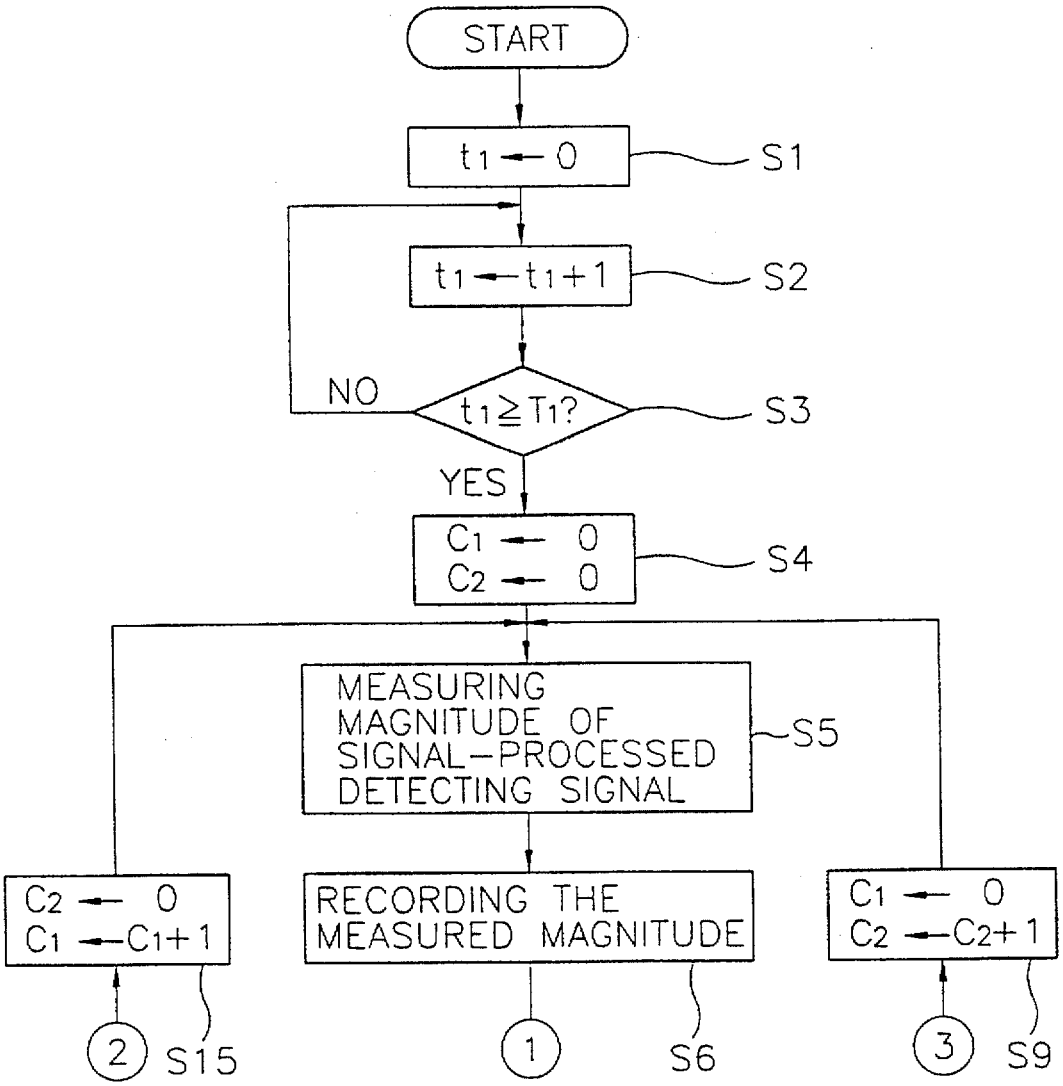
FIGS. 4A and 4B are flow charts for illustrating a method for automatically controlling cooking by using a vapor sensor in a microwave oven shown in FIG. 1.
Figure 4B:
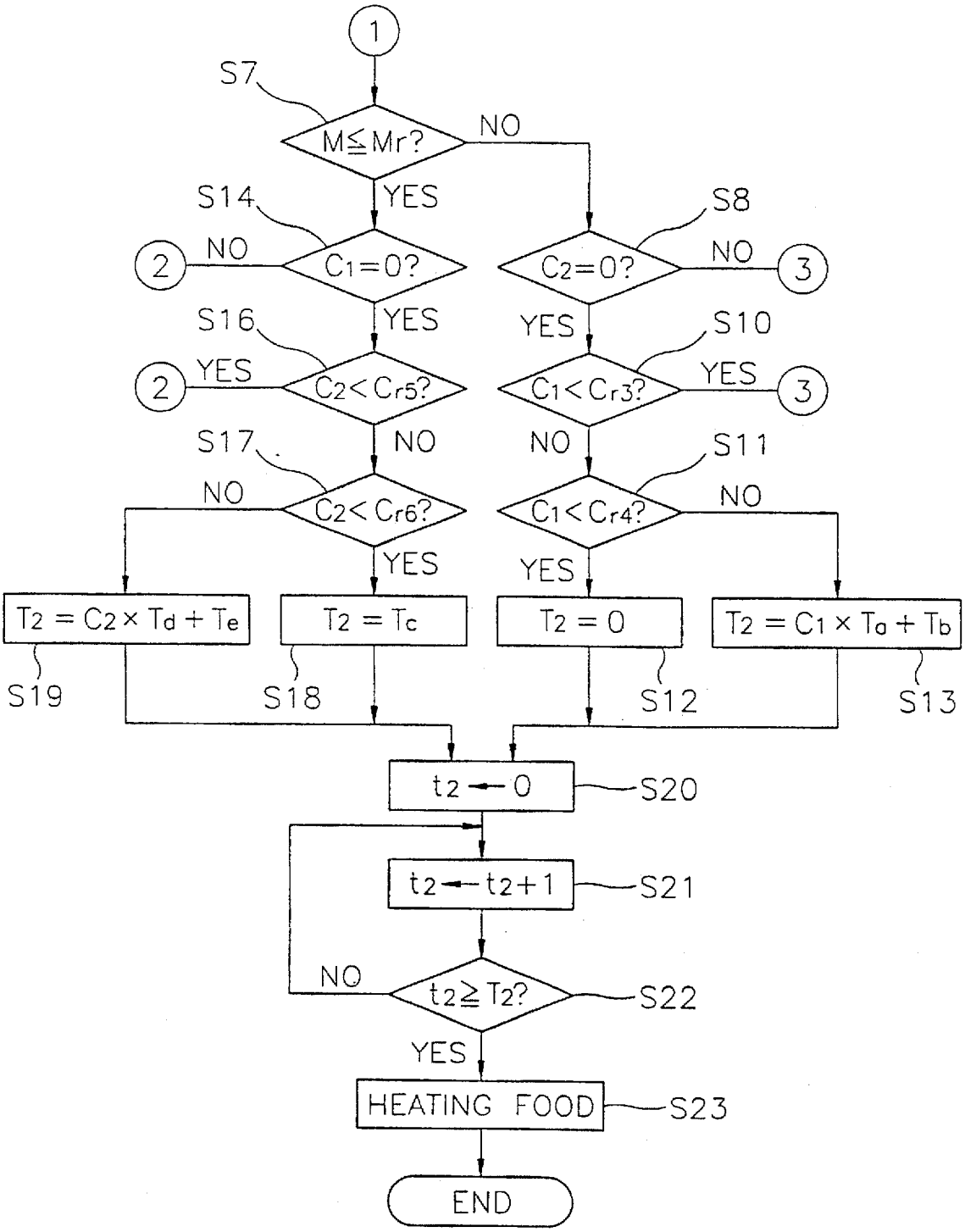
Figure 5:
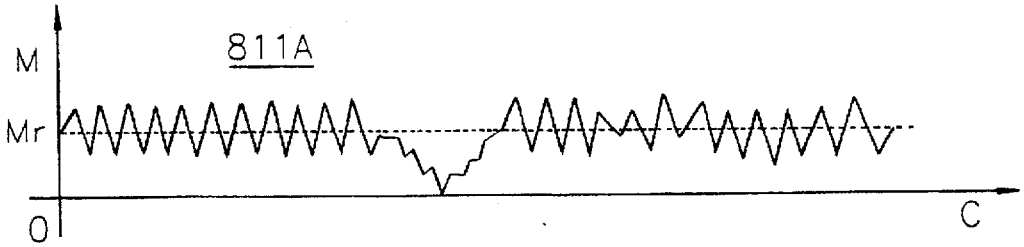
FIGS. 5, 6, 7 and 8 are respectively waveform diagrams for showing the waveforms of signal-processed detecting signals supplied from the detecting signal processing circuit section shown in FIG. 3.
Figure 6:
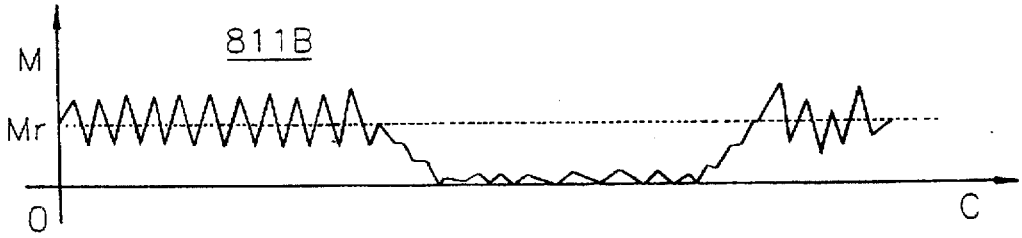
Figure 7:
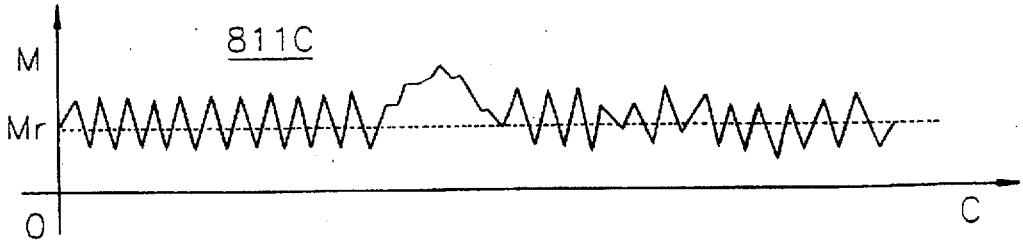
Figure 8:
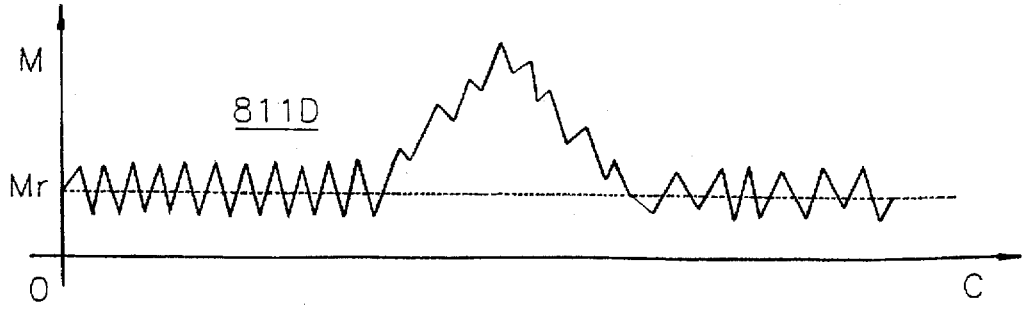

FIGS. 4A and 4B are flow charts illustrating a method for automatically controlling cooking by using a vapor sensor in a microwave oven shown in FIG. 1. FIGS. 5, 6, 7 and 8 are respectively waveform diagrams for showing the waveforms of signal-processed detecting signals supplied from the detecting signal processing circuit section shown in FIG. 3. The waveforms of signal-processed detecting signals 811 respectively shown in FIGS. 5, 6, 7 and 8, are the waveforms of the signals outputted at third commonly-connecting point 1013 of detecting signal processing circuit section 1000 shown in FIG. 3. As shown in FIGS. 4A and 4B, while the operation of automatically cooking food is executed by using microwave oven 10, having the above-described construction, control means 1100 (refer to FIG. 3) measures a magnitude M of signal-processed detecting signal 811 supplied from detecting signal processing circuit section 1000 which inputs and signal-processes detecting signal 810 supplied from vapor sensor 800, which varies according to the temperature of air that sequentially passes through cavity 300 and wind path 600 to be discharged, and then control means 1100 discriminates the polarity of vapor sensor 800. Thereby, control means 1100 can perform a proper automatic cooking operation. As shown in FIG. 5 and FIG. 6, in the case where X-axis is a phase coordinate axis for indicating a counting value C of a counter corresponding to a phase coordinate value, and where Y-axis is a magnitude coordinate axis for indicating the value of a magnitude M, then in general, magnitude M of signal-processed detecting signal 811 supplied from detecting signal processing circuit section 1000 is greater than or smaller than the magnitude $M_r$ of the reference detecting signal corresponding to an objective value.

Namely, either a "positive polarity mode", when magnitude M of signal-processed detecting signal 811 is greater than magnitude $M_r$ of the reference detecting signal, or a "negative polarity mode", when magnitude M of signal-processed detecting signal 811 is smaller than the magnitude $M_r$ of the reference detecting signal, appears. Also, a slope sign of the curve in signal-processed detecting signal 811 has a positive polarity or a negative polarity in a specified range of the phase coordinate axis. Here, the slope means a differential value at a certain point indicated by a pertinent phase coordinate value and magnitude coordinate value. That is, the polarity of signal-processed detecting signal 811 is positive while vapor sensor 800 sucks in heat, but the polarity of signal-processed detecting signal 811 is negative while vapor sensor 800 discharges heat. Therefore, control means 1100 compares magnitude M of signal-processed detecting signal 811 with magnitude $M_r$ of the reference detecting signal in the specified range on the phase coordinate axis, and meanwhile, discriminates whether the slope of the curve in the range is positive or negative, so that control means 1100 can discriminate whether vapor sensor 800 operates in the positive polarity mode or the negative polarity mode.

In the meantime, it is difficult to discriminate the polarity of detecting signal 810 supplied from vapor sensor 800 because vapor sensor 800 repeats the sucking-in and discharging of the heat in response to the temperature and the number of molecules of water vapor generated from the food which is subjected to heating while the food is cooked automatically. However, the polarity of detecting signal 810 supplied from vapor sensor 800 is discriminated by means of the waveform of signal-processed detecting signal 811 because detecting signal 810 always has a predetermined waveform in response to the wind produced by means of fan motor 400, which is one of many environmental conditions to which vapor sensor 800 responds.

General electrical characteristics of detecting signal 810 supplied from vapor sensor 800 are affected not only by environmental conditions such as the wind produced by fan motor 400, but also by the temperature of vapor sensor 800 and the amount of the water vapor which remains in cavity 300. Namely, various types of waveforms of detecting signal 810 are generated according to a variety of environmental conditions. Magnitude M of signal-processed detecting signal 811 supplied from detecting signal processing circuit section 1000 is proportional to the temperature and to the number of molecules in the water vapor generated from the food subjected to heating, and the above two factors also affect phase C of signal-processed detecting signal 811. Namely, magnitude M of signal-processed detecting signal 811 is affected by the temperature and the number of molecules in the water vapor, and phase C of signal-processed detecting signal 811 is also affected by the number of molecules in the water vapor.

Consequently, while an automatic cooking operation is being performed by means of the microwave oven equipped with vapor sensor 800 therein, it is automatically discriminated whether signal-processed detecting signal 811, which is supplied from detecting signal processing circuit section 1000 and which varies in accordance with the condition of the cooking chamber, is in a positive polarity mode or a negative polarity mode.

The method for automatically controlling cooking according to the present invention air-cools cavity 300 for an air cooling time by means of the driving of fan motor 400 during the automatic cooking operation, and respectively compares magnitude M and phase C of signal-processed detecting signal 811 supplied from detecting signal processing circuit section 1000 with magnitude $M_r$ of reference detecting signal and values of reference phases in order to discriminate the polarity of signal-processed detecting signal 811. Also, the executing time is discriminately adjusted during the air-cooling operation which is related to the cooking chamber and which is additionally provided in response to the discriminated polarity.

The method for automatically controlling cooking according to the present invention is described in the steps as follows. As shown in FIGS. 4A and 4B, if a user adjusts a start key (not shown) to the 'ON' state in order to initiate the automatic cooking operation, control means 1100 recognizes the 'ON' state of the start key and applies a control signal to a load driving means (not shown). At this time, control means 1100 initializes to zero a first operating time $t_1$ of a blowing means 400 such as fan motor 400 in step S1 and increases first operating time $t_1$ by "1" in step S2. The load driving means operates fan motor 400 for first operating time $t_1$ increased by "1" in order to start the blowing operation which blows cavity 300 through first blow holes 311 formed in the upper portion of first sidewall 310 (step S2). In step S3, control means 1100 judges whether or not first operating time $t_1$, which was increased by "1" in step S2, is greater than or equal to a first air cooling time $T_1$.

If first operating time $t_1$ is smaller than first air cooling time $T_1$, control means 1100 returns to step S2 and repeatedly performs the blowing operation of fan motor 400. Thereby, control means 1100 air-cools cavity 300 for first air cooling time $T_1$ and removes the water vapor which remains in cavity 300. If first operating time $t_1$ is greater than or equal to first air cooling time $T_1$, control means 1100 initializes to zero both value $C_1$ of the first counter (not shown) and value $C_2$ of the second counter (not shown) in order to measure the output of vapor sensor 800 in step S4. Here, the first counter is a means for counting the phase of signal-processed detecting signal 811 when magnitude M of signal-processed detecting signal 811 is equal to or smaller than magnitude $M_r$ of the reference detecting signal. Also, the second counter is a means for counting the phase of signal-processed detecting signal 811 when magnitude M of signal-processed detecting signal 811 is greater than magnitude $M_r$ of the reference detecting signal.

In the meantime, the wind, i.e., the flow of air produced by fan motor 400, flows out from first blow holes 311 formed in the upper portion of first sidewall 310 of cavity 300, passes sequentially through first exhaust holes 321 formed in the lower portion of second sidewall 320 disposed in opposition to first sidewall 310 and through first discharge holes 500, and is then discharged. Also, the wind passes sequentially through second exhaust holes 331 formed in the central portion of ceiling portion 330 of cavity 300, through wind path 600 and through second discharge holes 700, and is then discharged. At this time, because the wind discharged through wind path 500 is sensed by vapor sensor 800 installed at the inlet of second discharge holes 700, control means 1100 makes a first measuring means measure magnitude M of signal-processed detecting signal 811 supplied from detecting signal processing circuit section 1000 in step S5. In step S6, magnitude M, measured by the first measuring means, of signal-processed detecting signal 811 is recorded on a first memory means.

Control means 1100 judges in step S7 whether or not magnitude M of signal-processed detecting signal 811 is equal to or smaller than magnitude $M_r$ of the reference detecting signal. FIGS. 5, 6, 7 and 8 respectively are waveform diagrams showing the waveforms of signal-processed detecting signals supplied from the detecting signal processing circuit section shown in FIG. 3. In step S7, if magnitude M of signal-processed detecting signal 811 is greater than magnitude $M_r$ of the reference detecting signal in a specified range of the phase coordinate axis (see FIG. 7 or FIG. 8), control means 1100 judges in step S8 whether or not value $C_2$ of the second counter is zero. If value $C_2$ of the second counter is not zero in step S8, control means 1100 sets in step S9 value $C_1$ of the first counter and value $C_2$ of the second counter according to the following equation 1, and returns to step S5 in order to repeatedly perform the succeeding steps.

$$C_1 \leftarrow 0$$

$$C_2 \leftarrow C_2+1 \qquad \text{equation 1}$$

In step S8, if value $C_2$ of the second counter is zero, control means 1100 judges in step S10 whether or not value $C_1$ of the first counter is smaller than the value of a third reference phase $C_{r3}$. In step S10, if value $C_1$ of the first counter is smaller than the value of third reference phase $C_{r3}$, control means 1100 sets in step S9 value $C_1$ of the first counter and value $C_2$ of the second counter according to equation 1 above, and returns to step S5 in order to repeatedly perform the succeeding steps. In step S10, if value $C_1$ of the first counter is greater than or equal to the value of third reference phase $C_{r3}$, control means 1100 performs step S11.

In step S7, if magnitude M of signal-processed detecting signal 811 is equal to or smaller than magnitude $M_r$ of the reference detecting signal in a specified range of the phase coordinate axis (see FIG. 5 or FIG. 6), control means 1100 judges in step S14 whether or not value $C_1$ of the first counter is zero. If value $C_1$ of the first counter is not zero in step S14, control means 1100 sets value $C_1$ of the first counter and value $C_2$ of the second counter according to the following equation 2 in step S15, and returns to step S5 in order to repeatedly perform the succeeding steps.

$$C_2 \leftarrow 0$$

$$C_1 \leftarrow C_1+1 \qquad \text{equation 2}$$

In step S14, if value $C_1$ of the first counter is zero, control means 1100 judges in step S16 whether or not value $C_2$ of the second counter is smaller than the value of a fifth reference phase $C_{r5}$. In step S16, if value $C_2$ of the second counter is smaller than the value of fifth reference phase $C_{r5}$, control means 1100 sets in step S15 value $C_1$ of the first counter and value $C_2$ of the second counter according to equation 2 above, and returns to step S5 in order to repeatedly perform the succeeding steps. In step S16, if value $C_2$ of the second counter is greater than or equal to the value of fifth reference phase $C_{r5}$, control means 1100 performs step S17.

In step S11, control means 1100 judges whether or not value $C_1$ of the first counter is smaller than the value of a fourth reference phase $C_{r4}$. In step S11, if value $C_1$ of the first counter is smaller than the value of fourth reference phase $C_{r4}$, control means 1100 sets a second air cooling time $T_2$ related to a second operating time $t_2$ (i.e., an additionally-operating time) of the blowing means according to the following equation 3, and performs step S20.

$$T_2=0 \qquad \text{equation 3}$$

In step S11, if value $C_1$ of the first counter is greater than or equal to the value of fourth reference phase $C_{r4}$, control means 1100 sets second air cooling time $T_2$ related to second operating time $t_2$ of the blowing means according to the following equation 4, and performs step S20.

$$T_2=C_1 \times T_a+T_b \qquad \text{equation 4}$$

In step S17, control means 1100 judges whether or not value $C_2$ of the second counter is smaller than the value of a sixth reference phase $C_{r6}$. In step S17, if value $C_2$ of the second counter is smaller than the value of sixth reference phase $C_{r6}$, control means 1100 sets second air cooling time $T_2$ related to second operating time $t_2$ of the blowing means according to the following equation 5, and performs step S20.

$$T_2=T_c \qquad \text{equation 5}$$

In step S17, if value $C_2$ of the second counter is greater than or equal to the value of sixth reference phase $C_{r6}$, control means 1100 sets second air cooling time $T_2$ related to second operating time $t_2$ of the blowing means according to the following equation 6, and performs step S20.

$$T_2=C_2 \times T_d+T_e \qquad \text{equation 6}$$

In the equations 3 to 6, $T_a$, $T_b$, $T_c$, $T_d$ and $T_e$ are coefficients which are determined on the basis of data which is obtained by experiment. Thus, second air cooling time $T_2$ which corresponds to the additional air cooling time related to cavity 300, is determined by referring to data which is obtained by experiment.

Control means 1100 initializes to zero second operating time $t_2$ of fan motor 400 in step S20, and increases by "1" second operating time $t_2$ of fan motor 400 in step S21. The load driving means operates fan motor 400 for second operating time $t_2$ which was increased by "1", and initiates the blowing operation for blowing wind into the inner part of cavity 300 through first blow holes 311 formed at the upper portion of first sidewall 310 constituting cavity 300 (step S21). In step S22, control means 1100 judges whether or not second operating time $t_2$, which was increased by "1" in step S21, is greater than or equal to second air cooling time $T_2$.

If second operating time $t_2$ is smaller than second air cooling time $T_2$, control means 1100 returns to step S21 and repeatedly performs the blowing operation of fan motor 400. Accordingly, control means 1100 air-cools cavity 300 for second air cooling time $T_2$ and removes the water vapor which remains in cavity 300. If second operating time $t_2$ is greater than or equal to second air cooling time $T_2$, control means 1100 performs step S23.

In step S23, control means 1100 operates magnetron 200 and performs the operation for heating in succession food which is placed in cavity 300. Consequently, by means of the blowing operation of fan motor 400, the microwave energy supplied from magnetron 200 is delivered into the inner part of the cooking chamber through first blow holes 311 formed at the upper portion of first sidewall 310, and radiates to heat the food.

The related operation from step S7 to step S19 is summarized as follows. If magnitude M, measured in step S6, of signal-processed detecting signal 811 is greater than magnitude $M_r$ of the reference detecting signal (see FIG. 7 or FIG. 8), control means 1100 discriminates the polarity of signal-processed detecting signal 811 as the positive polarity mode. Control means 1100 counts the value of phase C of signal-processed detecting signal 811 by the first counter from the time when the polarity of signal-processed detecting signal 811 changes from the positive polarity mode to the negative polarity mode, and sequentially compares value $C_1$ of the first counter with the values of third and fourth reference phases $C_{r3}$ and $C_{r4}$. If value $C_1$ of the first counter is greater than or equal to the value of third reference phase $C_{r3}$ and is smaller than the value of fourth reference phase $C_{r4}$, then control means 1100 judges the range of value $C_1$ of the first counter according to the inequality 7 in order to set second air cooling time $T_2$ according to the equation 3.

$$C_{r3} \leqq C_1 < C_{r4} \qquad \text{inequality 7}$$

On the other hand, if value $C_1$ of the first counter is greater than or equal to the value of third reference phase $C_{r3}$ and is greater than or equal to the value of fourth reference phase $C_{r4}$, then control means 1100 judges the range of value $C_1$ of the first counter according to the inequality 8 in order to set second air cooling time $T_2$ according to the equation 4.

$$C_{r4} \leqq C_1 \qquad \text{inequality 8}$$

If magnitude M, measured in step S6, of signal-processed detecting signal 811 is equal to or smaller than magnitude $M_r$ of the reference detecting signal (see FIG. 5 or FIG. 6), control means 1100 discriminates the polarity of signal-processed detecting signal 811 as the negative polarity mode. Control means 1100 counts the value of phase C of signal-processed detecting signal 811 by the second counter from the time when the polarity of signal-processed detecting signal 811 changes from the negative polarity mode to the positive polarity mode, and sequentially compares value $C_2$ of the second counter with the values of fifth and sixth reference phases $C_{r5}$ and $C_{r6}$. If value $C_2$ of the second counter is greater than or equal to the value of fifth reference phase $C_{r5}$ and is smaller than the value of sixth reference phase $C_{r6}$, then control means 1100 judges the range of value $C_2$ of the second counter according to the inequality 9 in order to set second air cooling time $T_2$ according to the equation 5.

$$C_{r5} \leqq C_2 < C_{r6} \qquad \text{inequality 9}$$

On the other hand, if value $C_2$ of the second counter is greater than or equal to the value of fifth reference phase $C_{r5}$ and is greater than or equal to the value of sixth reference phase $C_{r6}$, then control means 1100 judges the range of value $C_2$ of the second counter according to the inequality 10 in order to set second air cooling time $T_2$ according to the equation 6.

$$C_{r6} \leqq C_2 \qquad \text{inequality 10}$$

When signal-processed detecting signals 811 respectively shown in FIGS. 5, 6, 7 and 8 are respectively referred to as first, second, third and fourth signal-processed detecting signals 811A, 811B, 811C and 811D, the range of values $C_1$ and $C_2$ of the first and second counters related to first, second, third and fourth signal-processed detecting signals 811A, 811B, 811C and 811D are respectively expressed as in Table 1 by the values of third, fourth, fifth and sixth reference phases $C_{r3}$, $C_{r4}$, $C_{r5}$ and $C_{r6}$.

TABLE 1

| signal | the range of the values of the counters |
|---|---|
| 811A | $C_{r3} \leqq C_1 < C_{r4}$ |
| 811B | $C_{r4} \leqq C_1$ |
| 811C | $C_{r5} \leqq C_2 < C_{r6}$ |
| 811D | $C_{r6} \leqq C_2$ |

Figure 9A:
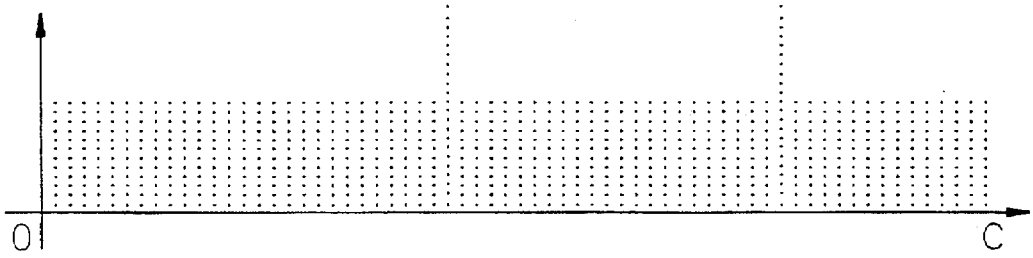
FIG. 9A is a drawing for showing a sampling time.
Figure 9B:
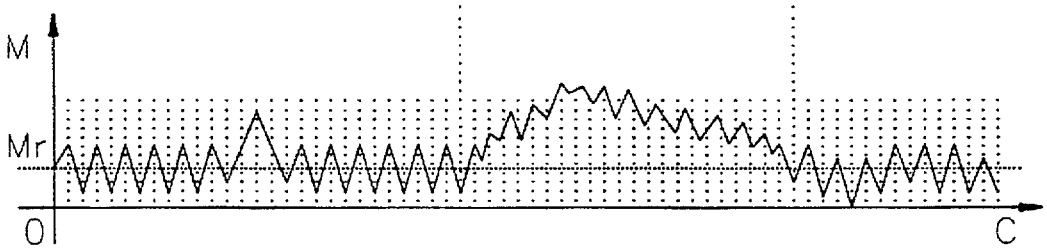
FIG. 9B is a waveform diagram for showing the waveform of the signal-processed detecting signal supplied from the detecting signal processing circuit section shown in FIG. 3 when the value of a second counter is greater than or equal to the value of a sixth reference phase.
Figure 9C:
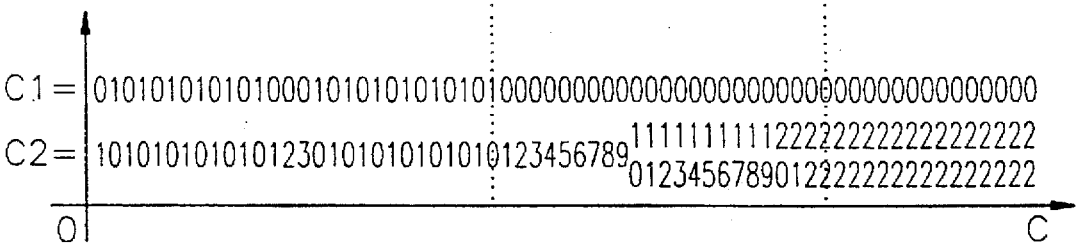
FIG. 9C is a drawing for illustrating the value of a first counter and the value of the second counter, which are respectively set with respect to the signal-processed detecting signal shown in FIG. 9B.
Figure 9D:
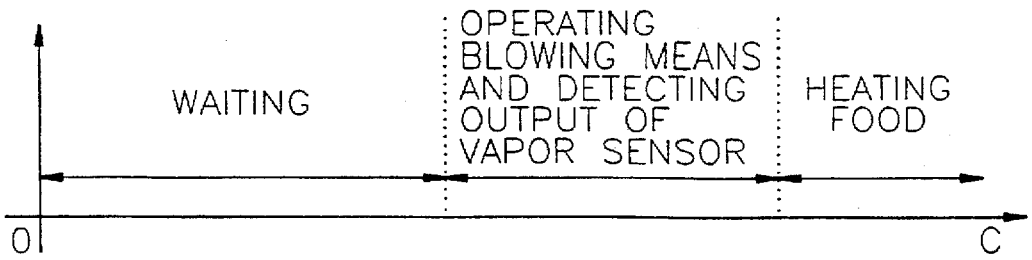
FIG. 9D is a drawing for illustrating operating modes of a control means during an automatic cooking operation of the microwave oven shown in FIG. 1.

FIG. 9A is a drawing for showing a sampling time. FIG. 9B is a waveform diagram for showing the waveform of the signal-processed detecting signal supplied from the detecting signal processing circuit section shown in FIG. 3 when the value of a second counter is greater than or equal to the value of a sixth reference phase. FIG. 9C is a drawing for illustrating the value of a first counter and the value of the second counter, which are respectively set with respect to the signal-processed detecting signal shown in FIG. 9B. FIG. 9D is a drawing for illustrating operating modes of a control means during an automatic cooking operation of the microwave oven shown in FIG. 1. As shown in FIGS. 9A, 9B, 9C and 9D, the operating modes of control means 1100 during the automatic cooking operation of the microwave oven is as follows. The values of third, fourth, fifth, and sixth reference phases $C_{r3}$, $C_{r4}$, $C_{r5}$ and $C_{r6}$ are respectively set to 5, 10, 4 and 14. When value $C_2$ of the second counter is 3 (see FIG. 9C), value $C_2$ of the second counter is smaller than the value of fifth reference phase $C_{r5}$=4 and is initialized to zero (step S15). Namely, value $C_2$ of the second counter is judged as a result which is caused by noise, and is neglected.

After value $C_2$ of the second counter becomes 22 from 21, magnitude M of signal-processed detecting signal 811 becomes smaller than magnitude $M_r$ of the reference detecting signal (see FIG. 9B). At this time, since magnitude M of signal-processed detecting signal 811 was greater than magnitude $M_r$ of the reference detecting signal and value $C_1$ of the first counter was zero in the previous state, control means 1100 judges on the basis of the determining condition of "C1=0 ?" (step S14) that the current time is the first time when the polarity of signal-processed detecting signal 811 changes. Therefore, control means 1100 compares value $C_2$=22 of the second counter in the previous state (i.e., $M>M_r$) with the value of fifth reference phase $C_{r5}$=4 (step S16). Then, since value $C_2$=22 of the second counter is greater than the value of fifth reference phase $C_{r5}$=4 and the value of sixth reference phase $C_{r6}$=14, value $C_2$ of the second counter satisfies the inequality 10. Consequently, control means 1100 sets second air cooling time $T_2$ according to the equation 6 and performs the continually-heating operation for food which is placed in the cooking chamber (see FIG. 9D).

In the method for automatically controlling cooking by using a vapor sensor in a microwave oven according to the present invention, while the automatic cooking operation is being performed by means of the microwave oven equipped with the vapor sensor therein, the executing time of the air cooling operation related to the cooking chamber, which is additionally provided in response to the polarity of the signal-processed detecting signal and which is discriminated in accordance with an environmental condition of the cooking chamber, is discriminately adjusted.

Therefore, an overcooked or an under-cooked result, caused by the additional air cooling time having a fixed value, is prevented so that the performance and the life span of the microwave oven are significantly enhanced to heighten the user's sense of reliability concerning the performance of the microwave oven and to fulfill the consumer's intention with which the microwave oven is purchased.

While the present invention has been particularly shown and described with reference to a particular embodiment thereof, it will be understood by those skilled in the art that various changes in form and detail may be effected therein without departing from the spirit and scope of the invention which is defined by the appended claims.

What is claimed is:

1. A method for automatically controlling cooking by using a vapor sensor in a microwave oven, said method comprising the steps of:

(i) operating a blowing means for a first operation time by a control means so as to remove water vapors, which remains in a cavity, thereby air-cooling the cavity while food is being cooked by using a microwave oven equipped with a vapor sensor therein;

(ii) initializing to zero both a value of a first counter and a value of a second counter in order to measure a magnitude of a signal-processed detecting signal supplied from a detecting signal processing circuit section, which inputs and signal-processes a detecting signal supplied from the vapor sensor;

(iii) recording the measured magnitude of the signal-processed detecting signal supplied from the detecting signal processing circuit section in response to the wind, which is produced by the operation of the blowing means and which passes sequentially through exhaust holes formed in the central portion of a ceiling portion of the cavity, through a wind path and through second discharge holes;

(iv) comparing the value of the first counter or the value of the second counter with values of reference phases in accordance with the measured magnitude of the signal-processed detecting signal;

(v) calculating a second air cooling time corresponding to an additional air cooling time in accordance with the value of the first counter or the value of the second counter;

(vi) operating by means of the control means the blowing means for the second air cooling time calculated in step (v) in order to additionally air-cool the cavity; and (vii) heating in succession food placed in the cavity, wherein the step (iv) comprises the substeps of:

(a) judging whether or not the magnitude, measured in step (iii), of the signal-processed detecting signal is equal to or smaller than a magnitude of a reference detecting signal;

(b) judging whether or not the value of the second counter is zero when it is judged in substep (a) that the magnitude of the signal-processed detecting signal is greater than the magnitude of the reference detecting signal;

(c) initializing to zero the value of the first counter, increasing by one the value of the second counter, and returning to step (iii) in order to repeat the succeeding steps when it is judged in substep (b) that the value of the second counter is not zero;

(d) judging whether or not the value of the first counter is smaller than a value of a third reference phase when it is judged in substep (b) that the value of the second counter is zero;

(e) initializing to zero the value of the first counter, increasing by one the value of the second counter, and returning to step (iii) in order to repeat the succeeding steps when it is judged in substep (d) that the value of the first counter is smaller than the value of the third reference phase;

(f) performing step (v) when it is judged in substep (d) that the value of the first counter is greater than or equal to the value of the third reference phase;

(g) judging whether or not the value of the first counter is zero when it is judged in substep (a) that the magnitude of the signal-processed detecting signal is equal to or smaller than the magnitude of the reference detecting signal;

(h) increasing by one the value of the first counter, initializing to zero the value of the second counter, and returning to step (iii) in order to repeat the succeeding steps when it is judged in substep (g) that the value of the first counter is not zero;

(i) judging whether or not the value of the second counter is smaller than a value of a fifth reference phase when it is judged in substep (g) that the value of the first counter is zero;

(j) increasing by one the value of the first counter, initializing to zero the value of the second counter, and returning to step (iii) in order to repeat the succeeding steps when it is judged in substep (i) that the value of the second counter is smaller than the value of the fifth reference phase; and (k) performing step (v) when it is judged in substep (i) that the value of the second counter is greater than or equal to the value of the fifth reference phase.

2. The method for automatically controlling cooking by using a vapor sensor in a microwave oven as claimed in claim 1, wherein said step (i) comprises the substeps of:

(a) initializing to zero the first operating time of the blowing means;

(b) increasing by one the first operating time of the blowing means;

(c) judging whether or not the first operating time of the blowing means increased by one in substep (b) is greater than or equal to a first air cooling time;

(d) returning to substep (b) and repeating the succeeding steps when it is judged in substep (c) that the first operating time of the blowing means is smaller than the first air cooling time; and (e) performing step (ii) when it is judged in substep (c) that the first operating time of the blowing means is greater than or equal to the first air cooling time.

3. The method for automatically controlling cooking by using a vapor sensor in a microwave oven as claimed in claim 1, wherein said step (iii) comprises the substeps of:

(a) measuring by a first measuring means the magnitude of the signal-processed detecting signal supplied from the detecting signal processing circuit section; and (b) recording on a first memory means the magnitude, measured in substep (a), of the signal-processed detecting signal.

4. The method for automatically controlling cooking by using a vapor sensor in a microwave oven as claimed in claim 1, wherein said step (v) comprises the substeps of:

(a) judging whether or not the value of the first counter having the value set in step (iv) is smaller than a value of a fourth reference phase;

(b) setting the second air cooling time of the blowing means to a first additionally-operating time when it is judged in substep (a) that the value of the first counter is smaller than the value of the fourth reference phase;

(c) setting the second air cooling time of the blowing means to a second additionally-operating time when it is judged in substep (a) that the value of the first counter is greater than or equal to the value of the fourth reference phase;

(d) judging whether or not the value of the second counter having the value set in step (iv) is smaller than a value of a sixth reference phase;

(e) setting the second air cooling time of the blowing means to a third additionally-operating time when it is judged in substep (d) that the value of the second counter is smaller than the value of the sixth reference phase; and (f) setting the second air cooling time of the blowing means to a fourth additionally-operating time when it is judged in substep (d) that the value of the second counter is greater than or equal to the value of the sixth reference phase.

5. The method for automatically controlling cooking by using a vapor sensor in a microwave oven as claimed in claim 4, wherein said first additionally-operating time is the right side of an equation of "$T_2=0$", where the second air cooling time is denoted by $T_2$.

6. The method for automatically controlling cooking by using a vapor sensor in a microwave oven as claimed in claim 4, wherein said second additionally-operating time is the right side of an equation of "$T_2=C_1\times T_a+T_b$", where the second air cooling time and the value of the first counter are respectively denoted by $T_2$ and $C_1$, and both $T_a$ and $T_b$ are coefficients determined on the basis of data obtained by experiment.

7. The method for automatically controlling cooking by using a vapor sensor in a microwave oven as claimed in claim 4, wherein said third additionally-operating time is the right side of an equation of "$T_2=T_c$", where the second air cooling time is denoted by $T_2$, and $T_c$ is a coefficient determined on the basis of data obtained by experiment.

8. The method for automatically controlling cooking by using a vapor sensor in a microwave oven as claimed in claim 4, wherein said fourth additionally-operating time is the right side of an equation of "$T_2=C_2\times T_d+T_e$", where the second air cooling time and the value of second counter are respectively denoted by $T_2$ and $C_2$, and both $T_d$ and $T_e$ are coefficients determined on the basis of data obtained by experiment.

9. The method for automatically controlling cooking by using a vapor sensor in a microwave oven as claimed in claim 4, where said value of the first counter has a range specified by an inequality of "$C_{r3}\leqq C_1<C_{r4}$" when the second air cooling time is set to the first additionally-operating time, where the value of the first counter, and the values of the third and fourth reference phases are respectively denoted by $C_1$, $C_{r3}$ and $C_{r4}$.

10. The method for automatically controlling cooking by using a vapor sensor in a microwave oven as claimed in claim 4, wherein said value of the first counter has a range specified by an inequality of "$C_{r4}\leqq C_1$" when the second air cooling time is set to the second additionally-operating time, where the value of the first counter and the value of the fourth reference phase are respectively denoted by $C_1$ and $C_{r4}$.

11. The method for automatically controlling cooking by using a vapor sensor in a microwave oven as claimed in claim 4, wherein said value of the second counter has a range specified by an inequality of "$C_{r5}\leqq C_2<C_{r6}$" when the second air cooling time is set to the third additionally-operating time, where the value of the second counter, and the values of the fifth and sixth reference phases are respectively denoted by $C_2$, $C_{r5}$ and $C_{r6}$.

12. The method for automatically controlling cooking by using a vapor sensor in a microwave oven as claimed in claim 4, wherein said value of the second counter has a range specified by an inequality of "$C_{r6}\leqq C_2$" when the second air cooling time is set to the fourth additionally-operating time, where the value of the second counter and the value of the sixth reference phase are respectively denoted by $C_2$ and $C_{r6}$.

13. The method for automatically controlling cooking by using a vapor sensor in a microwave oven as claimed in claim 1, wherein said step (vi) comprises the substeps of:

(a) initializing to zero the second operating time of the blowing means;

(b) increasing by one the second operating time of the blowing means;

(c) judging whether or not the second operating time, increased by one in substep (b), of the blowing means is greater than or equal to the second air cooling time;

(d) returning to substep (b) and repeating the succeeding steps when it is judged in substep (c) that the second operating time of the blowing means is smaller than the second air cooling time; and (e) performing step (vii) when it is judged in substep (c) that the second operating time of the blowing means is greater than or equal to the second air cooling time.

* * * * *